US010221507B2

(12) United States Patent
Yamauchi et al.

(10) Patent No.: US 10,221,507 B2
(45) Date of Patent: Mar. 5, 2019

(54) WEFT YARN MEASURING AND STORING DEVICE OF A LOOM

(71) Applicant: KABUSHIKI KAISHA TOYOTA JIDOSHOKKI, Kariya-shi, Aichi-ken (JP)

(72) Inventors: Yasushi Yamauchi, Aichi-ken (JP); Haruo Shimazaki, Aichi-ken (JP); Natsuki Kakiuchi, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 38 days.

(21) Appl. No.: 15/290,448

(22) Filed: Oct. 11, 2016

(65) Prior Publication Data

US 2017/0101731 A1 Apr. 13, 2017

(30) Foreign Application Priority Data

Oct. 12, 2015 (JP) ..... 2015-201666

(51) Int. Cl.
*D03D 47/36* (2006.01)

(52) U.S. Cl.
CPC ..... *D03D 47/362* (2013.01); *D03D 47/36* (2013.01)

(58) Field of Classification Search
CPC .... D03D 47/36; D03D 47/361; D03D 47/362; D03D 47/367
See application file for complete search history.

(56) References Cited

U.S. PATENT DOCUMENTS 3,915,199 A * 10/1975 Kida ..... D03D 47/361 139/452
4,347,872 A * 9/1982 Brouwer ..... D03D 5/00 139/435.1
4,529,017 A * 7/1985 Suzuki ..... D03D 47/367 139/452

(Continued)

FOREIGN PATENT DOCUMENTS

JP S62-198285 U 12/1987
JP 04-97886 U 8/1992

(Continued)

OTHER PUBLICATIONS

Communication dated Aug. 11, 2017 issued by the Intellectual Property Office of the Philippines Bureau of Patents in counterpart application No. 1/2016/000326.

(Continued)

*Primary Examiner* — Andrew W Sutton
(74) *Attorney, Agent, or Firm* — Sughrue Mion, PLLC

(57) ABSTRACT

A weft yarn measuring and storing device of a loom includes a drive roller, a support shaft, a support lever is turnably mounted to the support shaft, a feed roller that is rotatably mounted to the support lever and pressed to be contacted against the drive roller by a spring force so that the feed roller is rotated by rotation of the drive roller to pinch a weft yarn therebetween for feeding, and a storing drum that takes up and stores the fed weft yarn. The weft yarn measuring and storing device further includes a friction resistance imparting portion that imparts the support lever a friction resistance against turning of the support lever.

3 Claims, 5 Drawing Sheets

(56) References Cited

U.S. PATENT DOCUMENTS

| | | | | |
|---|---|---|---|---|
| 4,766,937 | A * | 8/1988 | Kojima | D03D 47/362 139/452 |
| 2003/0131900 | A1* | 7/2003 | Anada | D03D 47/361 139/1 R |
| 2017/0101731 | A1* | 4/2017 | Yamauchi | D03D 47/362 |

FOREIGN PATENT DOCUMENTS

| | | | |
|---|---|---|---|
| JP | H09-000356 | U | 6/1997 |
| JP | 2007-107147 | A | 4/2007 |

OTHER PUBLICATIONS

Communication dated Jan. 11, 2018, from Korean Intellectual Property Office in counterpart application No. 10-2016-0129079.

* cited by examiner

WEFT YARN MEASURING AND STORING DEVICE OF A LOOM

BACKGROUND OF THE INVENTION

The present invention relates to a weft yarn measuring and storing device of a loom.

For example, Japanese Unexamined Utility Model Application Publication No. 4-97886 discloses a weft yarn measuring and storing device having a roller mechanism that feeds a weft yarn in a weft package to a storing drum for storing therein the weft yarn. The weft yarn measuring and storing device of the Publication further has a rotary drum having at one axial end thereof an annular storing portion and at the other end thereof an annular measuring portion. A pressing roller is disposed in pressure contact with the measuring portion of the rotary drum by means of a spring. The pressing roller is rotated with the rotation of the measuring portion.

The weft yarn fed from the weft yarn package is pinched between the rotating pressing roller and the measuring portion of the rotating rotary drum and further fed out toward the storing portion. The weft yarn is wound around the storing portion by the action of air flow circling around the storing portion. At a start of a weft insertion, the weft yarn wound around the storing portion is pulled out through the weft insertion nozzle to be inserted. When the weft yarn on the storing portion is all pulled out, the weft yarn that is fed out through the rotation of the pressing roller and the measuring portion is directly used for weft insertion.

In the weft yarn measuring and storing device disclosed in the above Publication, when the drum is rotated at a high speed with an increase of the loom operating speed, a force acting against the pulling force of the spring is generated to thereby cause the pressing roller to be separated from the measuring portion of the drum. The function of feeding the weft yarn is stopped while the pressing roller is separated, which causes measurement of a weft yarn that is shorter than the required length. Such measurement of a weft yarn of an insufficient length by the weft yarn measuring and storing portion is a major factor of mispicking.

In order to prevent the separation of the pressing roller, it has been contemplated to increase the force of the spring by which the pressing roller is pressed to be contacted against the measuring portion of the drum. Generally, the surface of the pressing roller is clad with rubber for enhancing the weft yarn feeding performance. However, the increase of the force of the spring for increasing the pressing force of the pressing roller against the measuring portion significantly shortens the service life of the rubber covering the pressing roller, resulting in frequent replacements of the pressing rollers. Since the pressing roller that is integrally formed with the rubber covering is expensive, it is strongly desired that the frequency of replacement of the pressing rollers should be reduced.

In view of the circumstances above, the present invention is directed to providing a weft yarn measuring and storing device of a loom that prevents the separation of a feed roller of the weft yarn measuring and storing device that occurs during operation of the loom without increasing the frequency of replacement of the feed rollers.

SUMMARY OF THE INVENTION

In accordance with an aspect of the present invention, there is provided a weft yarn measuring and storing device of a loom that includes a drive roller, a support shaft, a support lever that is turnably mounted to the support shaft, a feed roller that is rotatably mounted to the support lever and pressed to be contacted against the drive roller by a spring force so that the feed roller is rotated by the rotation of the drive roller to pinch a weft yarn therebetween for feeding, and a storing drum that takes up and stores the fed weft yarn. The weft yarn measuring and storing device further includes a friction resistance imparting portion that imparts the support lever a friction resistance against turning of the support lever.

Other aspects and advantages of the invention will become apparent from the following description, taken in conjunction with the accompanying drawings, illustrating by way of example the principles of the invention.

DETAILED DESCRIPTION OF THE EMBODIMENTS

First Embodiment

Figure 1:
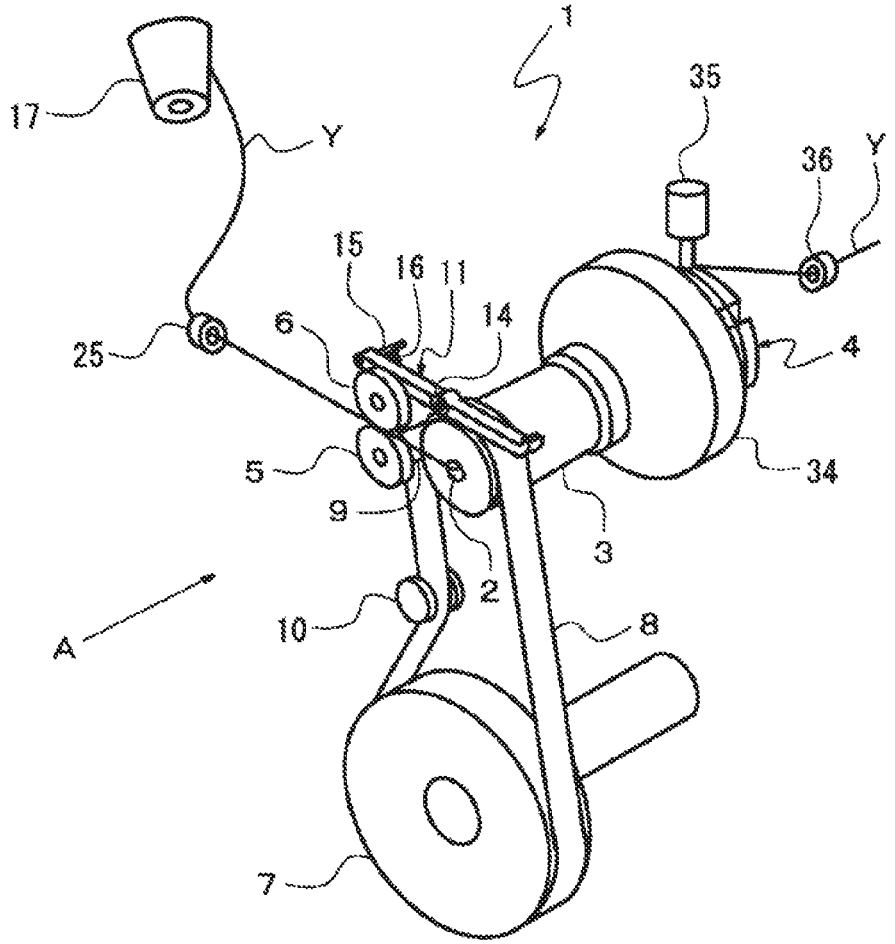
FIG. 1 is a schematic perspective view showing a weft yarn measuring and storing device according to a first embodiment of the present invention.
Figure 2:
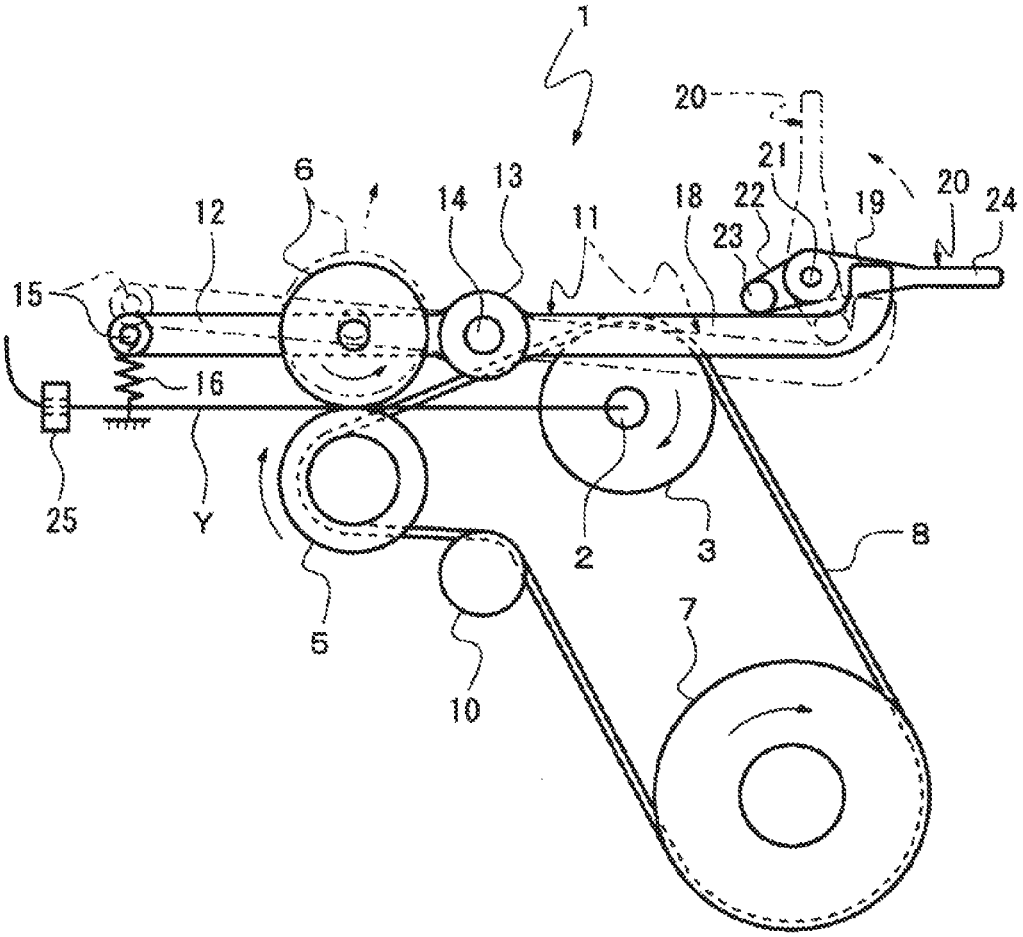
FIG. 2 is a side view of the weft yarn measuring and storing device as viewed in the direction of the arrow A in FIG. 1.
Figure 3:
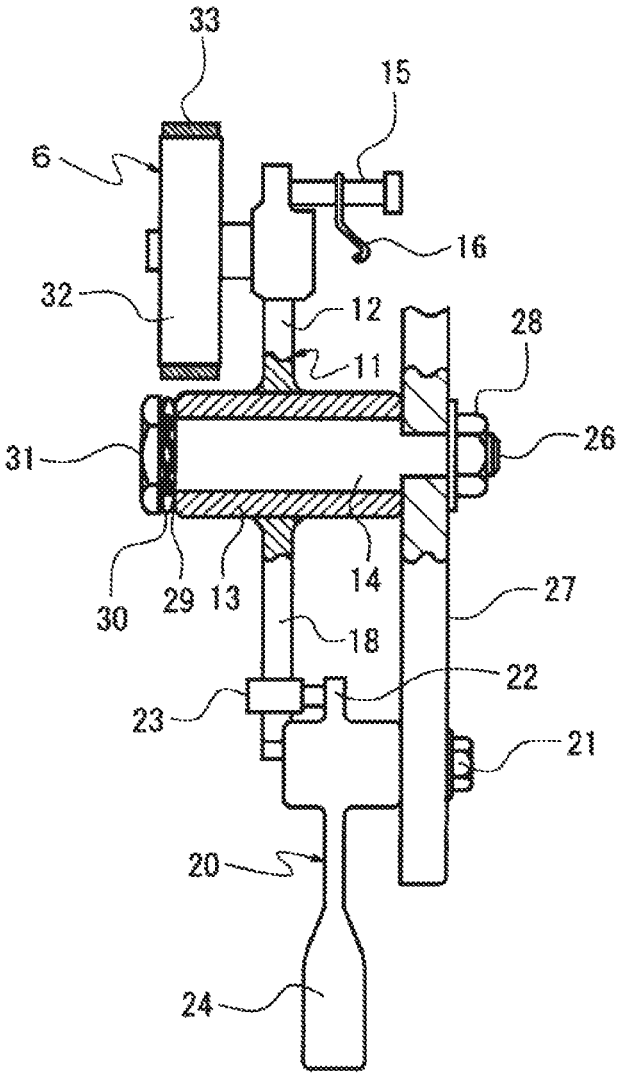
FIG. 3 is a partially cross-sectional top view of a feed roller, a support lever, and a support shaft of the weft yarn measuring and storing device according to the first embodiment.

A first embodiment of the present invention will now be described with reference to FIGS. 1 to 3. Referring firstly to FIGS. 1 and 2, there is shown a weft yarn measuring and storing device 1 in a loom. The weft yarn measuring and storing device 1 includes a rotary shaft 3 having a weft yarn inlet 2, a storing drum 4 that is stationary mounted at an end portion of the rotary shaft 3, and a drive roller 5 and a feed roller 6 that are provided with the axes thereof extending in parallel with the rotary shaft 3. A pulley 7 is provided below the rotary shaft 3 and connected to and rotated by a main shaft (not shown) of the loom. Alternatively, the pulley 7 is connected to an independent electric motor (not shown).

A drive belt 8 that is entrained around the pulley 7 is entrained around the rotary shaft 3, a shaft 9 of the drive roller 5, and a guide roller 10. The drive belt 8 may be provided by a timing belt or a plain belt. With the rotation of the pulley 7, the drive belt 8 is rotated to thereby rotate the rotary shaft 3 and the drive roller 5. Then, the feed roller 6 is rotated by the rotation of the drive roller 5. The guide roller 10 applies tension to the drive belt 8 by pressing so that the drive belt 8 is contacted with the rotary shaft 3 and the shaft 9 of the drive roller 5.

A support lever 11 having a first arm 12, a second arm 18, and a boss 13 formed between the first arm 12 and the second arm 18 is turnably mounted on a support shaft 14 through the boss 13. The feed roller 6 is rotatably mounted to the first arm 12 of the support lever 11. A pin 15 is mounted to the end of the first arm 12 of the support lever 11, extending at a right angle relative to the extending direction of the first arm 12. A spring 16 is connected at one end thereof to the pin 15 and at the other end thereof to a frame (not shown) of the loom or alternatively to a bracket (not shown) that is fixed to the frame.

The support lever 11 is pulled by the spring 16 so as to turn counterclockwise about the support shaft 14 as seen in FIG. 2 to thereby press the feed roller 6 to be contacted against the drive roller 5, increasing the pinching force between the drive roller 5 and the feed roller 6. With the rotation of the drive roller 5, a weft yarn Y that is drawn out from a weft yarn package 17 and passed through a guide 25 is pinched between the drive roller 5 and the feed roller 6 and fed toward the weft yarn inlet 2 of the rotary shaft 3.

The second arm 18 of the support lever 11 has at the end thereof a projecting portion 19 that is formed by being bent upward. In the weft yarn measuring and storing device 1, an operation lever 20 is provided above the end of the support lever 11. The operation lever 20 is supported at an intermediate position thereof so as to be turnable about a fixed shaft 21. The operation lever 20 has a first arm 22 and a second arm 24. A pressure pin 23 is mounted to the end of the first arm 22 of the operation lever 20 so as to extend on the upper surface of the second arm 18 of the support lever 11. The second arm 24 is formed in a flat plate shape (see FIG. 3) and functions as an operation portion. The operation lever 20 is normally positioned at the position indicated by the solid line in FIG. 2 and prevented from undesirably turning clockwise by a stop (not shown).

When the second arm 24 of the operation lever 20 is turned counterclockwise or in the direction indicated by the arrow of phantom line shown in FIG. 2, the pressure pin 23 of the first arm 22 of the operation lever 20 contacts the upper surface of the second arm 18 of the support lever 11 and pushes the second arm 18 downward. When the operation lever 20 is turned to the position illustrated by the phantom line, the support lever 11 is turned clockwise about the support shaft 14 to the position illustrated by the phantom line and the feed roller 6 is raised and separated away from the drive roller 5 to release the weft yarn Y pinched therebetween.

The operation to separate the drive roller 5 from the feed roller 6 is performed, for example, when threading a weft yarn Y into the yarn measuring and storing device 1. The operation lever 20 turned to the phantom-line position is held in the position by a known stop device (not shown) to maintain the feed roller 6 separated from the drive roller 5.

As shown in FIG. 1, a cover 34 is fixed on the rotary shaft 3. A weft yarn Y is fed into the weft yarn inlet 2 of the rotary shaft 3 and wound around the storing drum 4 inside the cover 34 by a take-up arm (not shown) that is attached to the rotary shaft 3. The weft yarn Y wound around the storing drum 4 is retained by a retainer pin 35 so that the weft yarn Y is not drawn for weft insertion. At a start of a weft insertion, the retainer pin 35 is actuated to release the weft yarn Y on the storing drum 4 and the released weft yarn Y is drawn through a guide 36 in the weft inserting direction.

The structures of the support lever 11 and the support shaft 14 will now be described in detail with reference to FIG. 3. The support shaft 14 has at one end thereof a threaded portion 26. The support shaft 14 is mounted to the frame 27 with the threaded portion 26 passed through the frame 27 and fixed to the frame 27 by a nut 28 fastened on the threaded portion 26. The boss 13 of the support lever 11 is fitted over the support shaft 14 so that the support lever 11 is turnable about and relative to the boss 13.

The other end of the support shaft 14 is protruded out of the end surface 29 of the boss 13 of the support lever 11 and a wave washer 30, which is an elastic member, is fitted over the other end of the support lever 11. The wave washer 30 is fastened by a bolt 31 that is screwed into a threaded hole (not shown) formed in the support shaft 14 so that the wave washer 30 is pressed to be contacted against the end surface 29 of the boss 13. The wave washer 30 is made of an elastic member, so that the elastic force of the wave washer 30 imparts the support lever 11 a friction resistance against turning of the support lever 11. The friction resistance of the wave washer 30 is determined to such an extent that does not affect the pulling force of the spring 16 acting on the support lever 11. The wave washer 30 corresponds to the friction resistance imparting member of the present invention.

The feed roller 6 is formed integrally by a body 32 and an annular rubber member 33 that is mounted on the outer periphery of the body 32. Specifically, the body 32 and the rubber member 33 are inseparably fixed to each other. Therefore, when the rubber member 33 is worn or damaged, the feed roller 6 needs to be replaced as a whole with a new one.

According to the first embodiment, during the operation of the loom, the feed roller 6 of the weft yarn measuring and storing device 1 rotates at a high speed and a weft yarn Y that is pinched between the feed roller 6 and the drive roller 5 is fed toward the weft yarn inlet 2 of the rotary shaft 3. The feed roller 6 tends to be separated from the drive roller 5 with an increase of the rotation speed of the feed roller 6. Specifically, while the feed roller 6 is rotating at a high speed, a force that acts to push the feed roller 6 upward is produced against the pulling force of the spring 16 and the feed roller 6 is raised upward away from the drive roller 5. However, the force acting to push the feed roller 6 upward is absorbed by the friction resistance between the wave washer 30 and the end surface 29 of the boss 13 of the support lever 11, so that the feed roller 6 rotates stably and weft insertion failures such as short picking of the weft yarn Y may be prevented.

According to the first embodiment of the present invention in which the wave washer 30 is interposed between the support lever 11 and the bolt 31 and functions to reduce the force acting to push the feed roller 6 upward against the pulling force of the spring 16, the durability of the feed roller 6 is not lowered as compared with a case in which the pulling force of the spring 16 by which the feed roller 6 is pressed to be contacted against the drive roller 5 is increased.

Furthermore, the weft yarn measuring and storing device according to the first embodiment using a commercially-available wave washer for the wave washer 30 is advantageous in that the separation of the feed roller 6 from the drive roller 5 is prevented successfully with a simple structure. Furthermore, installation of the wave washer 30 is easy because the wave washer 30 is mounted to the end surface 29 of the support lever 11.

Second Embodiment

Figure 4:
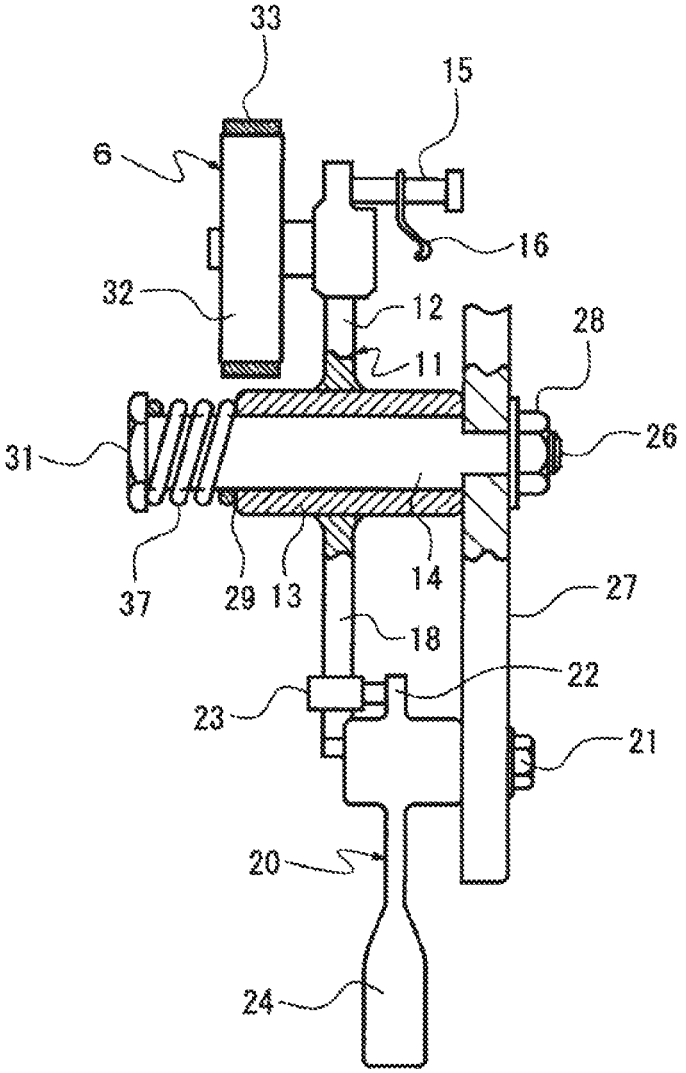
FIG. 4 is a partially cross-sectional top view of a feed roller, a support lever, and a support shaft of a weft yarn measuring and storing device according to a second embodiment of the present invention.

The following will describe a second embodiment of the present invention with reference to FIG. 4. It is to be noted that the configuration and the parts of the second embodiment that are identical to the counterparts in the first embodiment will be designated using the same reference numerals, and the detailed description thereof will be simplified or omitted. The second embodiment of the present invention is different from the first embodiment in that a coil spring 37, which is an elastic member, is used as the friction resistance imparting portion. The coil spring 37 is mounted on the end portion of the support shaft 14 protruding out from the end surface 29 of the boss 13 of the support lever 11. The bolt 31 is screwed into the threaded hole (not shown) of the support shaft 14 with the coil spring 37 mounted thereon, so that the bolt 31 presses the coil spring 37 to be contacted against the end surface 29 of the boss 13.

According to the second embodiment, the elastic force of the coil spring 37 interposed between the support lever 11 and the bolt 31 imparts a friction resistance to the end surface 29 of the boss 13. Therefore, the force acting to push the feed roller 6 upward against the pulling force of the spring 16 is absorbed and the separation of the feed roller 6 from the drive roller 5 is prevented. Thus, the second embodiment offers the effects equivalent to those of the first embodiment are obtained. Furthermore, the coil spring 37 provides a wider range of friction resistance as compared with the wave washer 30 of the first embodiment.

Third Embodiment

Figure 5:
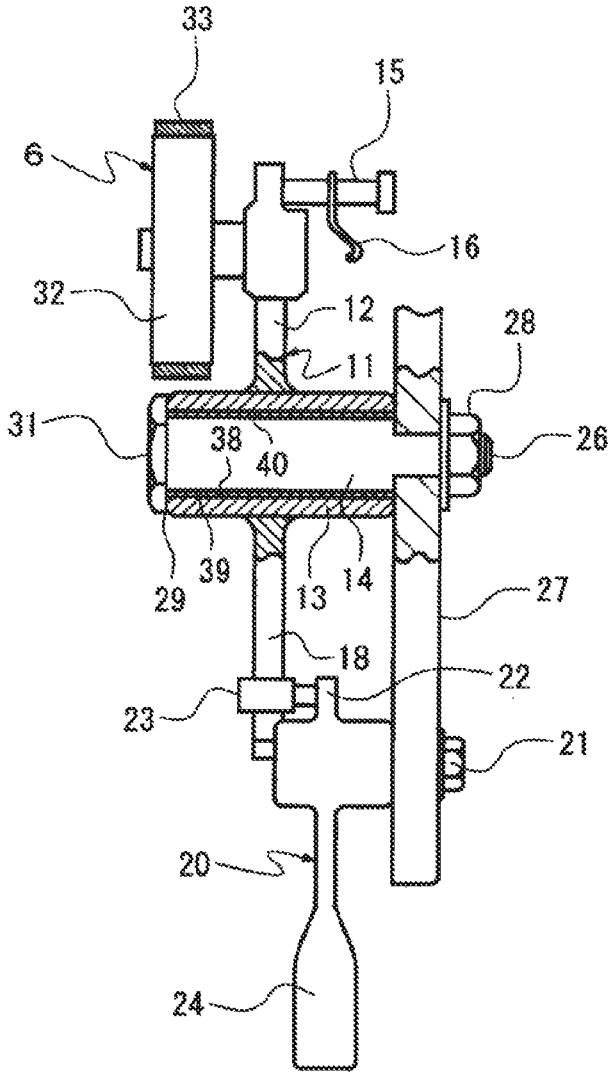
FIG. 5 is a partially cross-sectional top view of a feed roller, a support lever, and a support shaft of a weft yarn measuring and storing device according to a third embodiment of the present invention.

A third embodiment of the present embodiment will now be described with reference to FIG. 5. It is to be noted that the configuration and the parts of the third embodiment that are identical to the counterparts in the first embodiment will be designated using the same reference numerals, and the detailed description thereof will be simplified or omitted. The friction resistance imparting portion according to the third embodiment is provided by a cylindrical member 38 that is fixed on an outer peripheral surface 39 of the support shaft 14. The cylindrical member 38 is fixedly mounted on the outer peripheral surface 39 of the support shaft 14 that is a contact between the cylindrical member 38 and the support lever 11. A surface-roughening treatment, such as plating, shot blast, and shot peening is provided on the outer peripheral surface of the cylindrical member 38 so that the friction resistance between the outer peripheral surface of the cylindrical member 38 and the inner peripheral surface 40 of the boss 13 is increased.

The boss 13 of the support lever 11 has an inner peripheral surface 40 that is a contact with the support shaft 14. The boss 13 is fitted on the cylindrical member 38 of the support shaft 14 so that the support lever 11 is turnable about and relative to the support shaft 14. The boss 13 of the support lever 11 is integrated with the support shaft 14 by being fastened with the bolt 31. A friction resistance is imparted to the support lever 11 by the inner peripheral surface 40 of the boss 13 contacting with the roughened outer peripheral surface of the cylindrical member 38.

It is to be noted that, the cylindrical member 38 of the third embodiment that corresponds to the friction resistance imparting portion of the present invention may be replaced with a different member having an arc shape and fixedly provided on the outer peripheral surface 39 of the support shaft 14. Alternatively, the cylindrical member 38 may be fixedly provided on the inner peripheral surface 40 of the boss 13 of the support lever 11. Still alternatively, the cylindrical member 38 may be loosely and rotatably mounted between the outer peripheral surface 39 of the support shaft 14 and the inner peripheral surface 40 of the boss 13 of the support lever 11. The cylindrical member 38 also corresponds to the rough surface portion of the present invention. Yet alternatively, a surface-roughening treatment may be provided on the outer peripheral surface 39 of the support shaft 14 or the inner peripheral surface 40 of the support lever 11 to form the friction resistance imparting portion.

According to the third embodiment, the cylindrical member 38 is interposed between the support lever 11 and the support shaft 14 to impart a friction resistance to the inner peripheral surface 40 of the boss 13 of the support lever 11. Therefore, the force acting to push the feed roller 6 upward against the pulling force of the spring 16 is absorbed and the separation of the feed roller 6 from the drive roller 5 is prevented. Thus, the third embodiment offers the effects equivalent to those of the first embodiment. Furthermore, according to the third embodiment in which the cylindrical member 38 is disposed between the support shaft 14 and the support lever 11, the structure of the weft yarn measuring and storing device 1 is simple and the sizes of the assembly of the support shaft 14 and the support lever 11 will not be increased.

It is to be noted that the present invention is not limited to the configurations of the above embodiments and may variously be modified within the scope of the present invention, for example, in the following manners.

(1) In the first embodiment, a disc spring washer may be used instead of the wave washer 30.

(2) In the third embodiment, the cylindrical member 38 is provided as the friction resistance imparting portion. However, a surface-roughening treatment may alternatively be provided on the end surface 29 of the boss 13 of the support lever 11 that serves as a contact with the support shaft 14 or on the surface of the head of the bolt 31 facing the end surface 29, so that the friction resistance imparted prevents the separation of the feed roller 6.

(3) In the first to third embodiments, the weft yarn measuring and storing device 1 in which a weft yarn Y is wound around the storing 4 using the take-up arm (not shown) and the retainer pin 35 may be replaced by a weft yarn measuring and storing device of the type in which a weft yarn Y is wound by utilizing a circling air flow as disclosed in the Japanese Unexamined Utility Model Application Publication No. 4-97886.

(4) The weft yarn measuring and storing device 1 according to the first to third embodiments may be used in various types of looms, such as a water jet loom, an air jet loom, and a rapier loom.

What is claimed is:

1. A weft yarn measuring and storing device of a loom, comprising:

a drive roller;

a support shaft, a support lever that is turnably mounted to the support shaft;

a feed roller that is rotatably mounted to the support lever and pressed to be contacted against the drive roller by a spring force so that the feed roller is rotated by rotation of the drive roller to pinch a weft yarn therebetween for feeding; and a storing drum that takes up and stores the fed weft yarn, wherein the weft yarn measuring and storing device further includes a friction resistance imparting portion that imparts the support lever a friction resistance against turning of the support lever, the support lever has a fit portion that is fitted to the support shaft, the friction resistance imparting portion is formed by an elastic member, and the elastic member is a wave washer or a coil spring that is disposed in contact with an end surface of the fit portion.

2. A weft yarn measuring and storing device of a loom, comprising:

a drive roller;

a support shaft, a support lever that is turnably mounted to the support shaft;

a feed roller that is rotatably mounted to the support lever and pressed to be contacted against the drive roller by a spring force so that the feed roller is rotated by rotation of the drive roller to pinch a weft yarn therebetween for feeding; and a storing drum that takes up and stores the fed weft yarn, wherein the weft yarn measuring and storing device further includes a friction resistance imparting portion that imparts the support lever a friction resistance against turning of the support lever and the friction resistance imparting portion is a rough surface portion formed by a surface-roughening treatment so as to have a surface that is rougher than an untreated portion and that increases the friction resistance between the support shaft and the support lever.

3. The weft yarn measuring and storing device according to claim 2, wherein the rough surface portion is provided on a cylindrical member that is disposed between an outer peripheral surface of the support shaft and an inner peripheral surface of a fit portion of the support lever.

* * * * *